US010285501B2

(12) United States Patent
Hamon et al.

(10) Patent No.: US 10,285,501 B2
(45) Date of Patent: May 14, 2019

(54) SLIDE SYSTEM AND SLIDE ASSEMBLY FOR A DRAWER AND DRAWER ASSEMBLY

(71) Applicant: DASSAULT AVIATION, Paris (FR)

(72) Inventors: Ludovic Hamon, Little Rock, AR (US); Grégory Le Floc'h, Little Rock, AR (US)

(73) Assignee: DASSAULT AVIATION, Paris (FR)

( * ) Notice: Subject to any disclaimer, the term of this patent is extended or adjusted under 35 U.S.C. 154(b) by 0 days.

(21) Appl. No.: 15/334,572

(22) Filed: Oct. 26, 2016

(65) Prior Publication Data

US 2018/0110334 A1 Apr. 26, 2018

(51) Int. Cl.

| | |
|---|---|
| ***A47B 88/43*** | (2017.01) |
| ***A47B 88/45*** | (2017.01) |
| ***A47B 88/493*** | (2017.01) |
| ***A47B 88/487*** | (2017.01) |

(52) U.S. Cl.

CPC ..... *A47B 88/43* (2017.01); *A47B 88/45* (2017.01); *A47B 88/487* (2017.01); *A47B 88/493* (2017.01); *A47B 2210/0059* (2013.01); *A47B 2210/0078* (2013.01)

(58) Field of Classification Search

CPC ..... A47B 88/14; A47B 88/044; A47B 88/10; A47B 2210/0078

USPC ..... 312/331, 334.7

See application file for complete search history.

(56) References Cited

U.S. PATENT DOCUMENTS

| | | | | | |
|---|---|---|---|---|---|
| 3,857,618 | A | * | 12/1974 | Hagen | A47B 88/493 312/331 |
| 4,037,885 | A | * | 7/1977 | Rock | A47B 88/493 384/19 |
| 4,121,876 | A | * | 10/1978 | Ratti | A47B 88/493 312/334.13 |
| 4,348,063 | A | * | 9/1982 | Chambers | A47B 88/493 312/334.11 |
| 4,552,415 | A | * | 11/1985 | Fulterer | A47B 88/427 312/330.1 |
| 5,344,227 | A | * | 9/1994 | Rock | A47B 88/467 312/334.33 |
| 5,344,228 | A | * | 9/1994 | Kovarik | A47B 88/493 312/334.17 |
| 5,584,550 | A | * | 12/1996 | Kueng | A47B 88/427 312/334.14 |

(Continued)

*Primary Examiner* — Daniel J Troy
*Assistant Examiner* — Timothy M Ayres

(57) ABSTRACT

A slide system for slidably opening and closing a drawer is provided. The slide system includes an outer slide for mounting the slide system on a side wall of an enclosure, comprising a longitudinal slide outer channel, a sliding member, configured to be mounted on a side wall of the drawer, slidably movable within said slide outer channel. The outer slide includes a fixing part for attachment of the outer slide on the side wall of the enclosure, a sliding part comprising said slide outer channel, and an intermediate part, extending from said fixing part to said sliding part. The fixing part, the intermediate part and the sliding part define a groove extending upwardly from said intermediate part. The slide system comprises a casing element for encasing the sliding member by extending vertically from an upper portion the side wall of the drawer towards the intermediate part of the outer slide and being at least partly received within the groove.

25 Claims, 7 Drawing Sheets

(56) References Cited

U.S. PATENT DOCUMENTS

| | | | | |
|---|---|---|---|---|
| 5,980,007 | A * | 11/1999 | Singh | A47B 88/427 248/222.11 |
| 6,499,818 | B2 * | 12/2002 | Brustle | A47B 88/467 312/319.1 |
| 7,997,668 | B2 * | 8/2011 | Lee | F25D 25/025 312/331 |
| 8,074,468 | B2 * | 12/2011 | Yoo | F25D 25/025 62/440 |
| 8,091,971 | B2 * | 1/2012 | Ward | A47B 88/40 312/333 |
| 8,210,623 | B2 * | 7/2012 | Chen | A47B 88/49 312/331 |
| 9,504,323 | B1 * | 11/2016 | Porreca | A47B 88/0407 |
| 9,845,985 | B1 * | 12/2017 | Alyanak | F25D 25/024 |
| 2004/0000851 | A1 * | 1/2004 | Lam Harn | A47B 88/493 312/334.7 |
| 2009/0248205 | A1 * | 10/2009 | Yu | F25D 25/025 700/275 |
| 2010/0019637 | A1 * | 1/2010 | Guttinger | A47B 88/493 312/334.5 |
| 2013/0129266 | A1 * | 5/2013 | Chen | A47B 88/40 384/20 |

* cited by examiner

SLIDE SYSTEM AND SLIDE ASSEMBLY FOR A DRAWER AND DRAWER ASSEMBLY

The invention relates to a slide system for slidably opening and closing a drawer with respect to an enclosure, said slide system comprising:

an outer slide for mounting said slide system on a side wall of the enclosure, said outer slide comprising a longitudinal slide outer channel, a sliding member, configured to be mounted on a side wall of the drawer, said sliding member being slidably movable within said slide outer channel.

In particular, the invention relates to a slide system and to a drawer for a cabinet in an aircraft.

Several storage drawers are offered to the crew and to the passengers of the aircraft, throughout the cabin. Most of the drawers are attached to the cabinets by means of extension slides, the drawers being slidably movable with respect to the cabinet between an open position and a closed position, to provide access to the contents of the drawers.

Especially, the drawers are attached to the inner walls of the cabinet by means of a slide assembly including two slide systems, each of them being mounted between a side wall of the drawer and a side wall of the enclosure.

BACKGROUND

A slide system for a drawer typically includes an outer slide, fixed to an inner wall of the cabinet. The slide system further comprises a sliding member, mounted on an outer side wall of the drawer, and engaging the outer slide, the sliding member being slidably movable relative to the outer slide.

For example, the sliding member comprises an inner rail, fixed on the outer side of the drawer, and a middle rail, slidably movable with respect to the inner rail.

SUMMARY OF THE INVENTION

When the drawer is slided towards the open position, the sliding members are visible on both sides of the drawer. Especially, when the drawer is fully extended, i.e. in the open position, both the inner and the middle rail are visible.

Besides, when the drawer is fully extended, the drawer may oscillate in a transversal direction, which is an horizontal direction orthogonal to the sliding direction. This oscillation effect is due to the low moment of inertia of the slides when loaded in this direction, allowing desynchronized slides.

One aim of the invention therefore consists in providing a slide system for a drawer and a drawer assembly solving at least one of these problems, especially allowing sliding the drawer whilst avoiding an exposure of the slide system.

To that end, the invention provides a slide system for slidably opening and closing a drawer with respect to an enclosure, said slide system comprising:

an outer slide for mounting said slide system on a side wall of the enclosure, said outer slide comprising a longitudinal slide outer channel, a sliding member, configured to be mounted on a side wall of the drawer, said sliding member being slidably movable within said slide outer channel, wherein said outer slide comprises:

a fixing part for attachment of the outer slide on the side wall of the enclosure, a sliding part comprising said slide outer channel, and an intermediate part, extending from said fixing part to said sliding part, the fixing part, the intermediate part and the sliding part defining a groove extending upwardly from said intermediate part, and wherein the slide system further comprises a casing element configured for encasing the sliding member by extending vertically from an upper portion the side wall of the drawer towards the intermediate part of the outer slide and being at least partly received within the groove.

The slide system according to the invention may comprise one or more of the following features, considered alone or according to any technically possible combination:

- the slide system further comprises a spacer, configured to be interposed between the side wall of the drawer and the casing element;
- the sliding member comprises an inner rail, configured to be mounted in a fixed position relative to the side wall of the drawer, and a middle rail, mounted on said inner rail, said middle rail being slidably movable within said slide outer channel relative to said outer slide, and being slidably movable relative to said inner rail;
- the sliding member further comprises an interface rail configured to be fixed to the side wall of the drawer, the inner rail being releasably fixable to said interface rail;
- the sliding part comprises an upper arm, a lower arm and a side arm, the side arm extending between the upper arm and the lower arm, the upper arm, the lower arm and the side arm jointly defining the slide outer channel;
- the groove is defined by the fixing part, the intermediate part and the side arm;
- the slide system further comprises a longitudinal rack, destined to be fixed relative to the enclosure, a pinion configured to be mounted on the drawer and to engage teeth of the rack while rotating about itself when the drawer slides with respect to the outer slide, and a pinion support assembly for mounting the pinion on the drawer;
- the sliding part comprises an upper arm, a lower arm and a side arm, the side arm extending between the upper arm and the lower arm, the upper arm, the lower arm and the side arm jointly defining the slide outer channel, the longitudinal rack is formed on an upper surface of the upper arm, and the pinion support assembly is configured for being fixed to a rear wall of the drawer and for mounting the pinion protruding transversally from the side wall of the drawer.

The invention also provides a slide assembly comprising a first and a second slide systems, each of the first and second slide systems being according to the invention.

The slide assembly according to the invention may comprise one or more of the following features, considered alone or according to any technically possible combination:

- each of the first and second slide systems comprise a longitudinal rack, destined to be fixed relative to the enclosure, a pinion configured to be mounted on the drawer and to engage teeth of the rack while rotating about itself when the drawer slides with respect to the outer slide, and a pinion support assembly for mounting the pinion on the drawer, and the slide assembly further comprises a shaft rotationally connecting the pinion of the first slide system to the pinion of the second slide system;
- each pinion support assembly comprises:
  - a bearing support configured to be fixed to a rear wall of the drawer, the bearing support comprising a transversal through hole, and a pinion axis rotatably mounted on the bearing support by being partly received in the transversal through hole, each pinion axis is provided with a first pattern of pin holes, distributed transversally, and each end portion of the shaft is provided with a second pattern of pin holes, distributed transversally, a distance separating the pin holes of the first pattern differing from a distance separating the pin holes of the second pattern, each pinion axis being configured to be fixed to the corresponding end portion of the shaft by a spring pin engaging a pin hole of pinion axis and a pin hole of the end portion of the shaft.

The invention also provides a drawer assembly comprising:

a drawer having a first and a second side walls, a slide assembly according to the invention, the sliding member of the first slide system being mounted on the first side wall of the drawer, and the sliding member of the second slide system being mounted on the second side wall of the drawer.

The drawer assembly according to the invention may comprise one or more of the following features, considered alone or according to any technically possible combination:

the casing element of the first slide system is made integral with the first side wall of the drawer, and the casing element of the second slide system is made integral with the second side wall of the drawer, the first slide system comprises a spacer, interposed between the first side wall of the drawer and the casing element of the first slide system, and the second slide system comprises a spacer, interposed between the second side wall of the drawer and the casing element of the second slide system the sliding member of the first and second slide systems comprises an inner rail, mounted in a fixed position relative to the first and second side walls of the drawer respectively, and a middle rail, mounted on said inner rail, said middle rail being slidably movable within said slide outer channel relative to said outer slide, and being slidably movable relative to said inner rail;

the sliding member of the first and second slide systems further comprises an interface rail fixed to the first and second side walls of the drawer respectively, the inner rail being releasably fixed to said interface rail;

the sliding part of each outer slide comprises an upper arm, a lower arm and a side arm, the side arm extending between the upper arm and the lower arm, the upper arm, the lower arm and the side arm jointly defining the slide outer channel;

the groove is defined by the fixing part, the intermediate part and the side arm;

each slide system further comprises a longitudinal rack, fixed relative to the enclosure, a pinion mounted on the drawer and configured to engage teeth of the rack while rotating about itself when the drawer slides with respect to the outer slide, and a pinion support assembly for mounting the pinion on the drawer;

the sliding part of the outer slide of each of the first and second slide systems comprises an upper arm, a lower arm and a side arm, the side arm extending between the upper arm and the lower arm, the upper arm, the lower arm and the side arm jointly defining the slide outer channel, the longitudinal rack is formed on an upper surface of the upper arm, the pinion support assembly is fixed to a rear wall of the drawer and the pinion protrudes transversally from the first and second side walls of the drawer respectively.

The invention also provides a cabinet assembly comprising:

a enclosure having a first and a second side walls, and a drawer assembly according to the invention, the outer slide of the first slide system being mounted on the first side wall of the enclosure and engaging the sliding member of the first slide system, and the outer slide of the second slide system being mounted on the second side wall of the enclosure and engaging the sliding member of the second slide system.

BRIEF SUMMARY OF THE DRAWINGS

The invention will be better understood upon reading the following description, provided solely as an example, and done in reference to the appended drawings, in which.

DETAILED DESCRIPTION

FIGS. 1 to 6 show a drawer assembly 1 according to a first embodiment of the invention.

The drawer assembly 1 comprises a drawer 3 and a slide assembly 5.

The drawer 3 is slidably mounted between an open and a closed position, by means of the slide assembly 5, in an enclosure 7.

The drawer 3 comprises a first and a second side wall 3*a*, 3*b*, a bottom wall 3*c*, a front wall 3*d* and a rear wall 3*e*.

The enclosure 7 is for example an enclosure of a cabinet in an aircraft.

Figure 1:
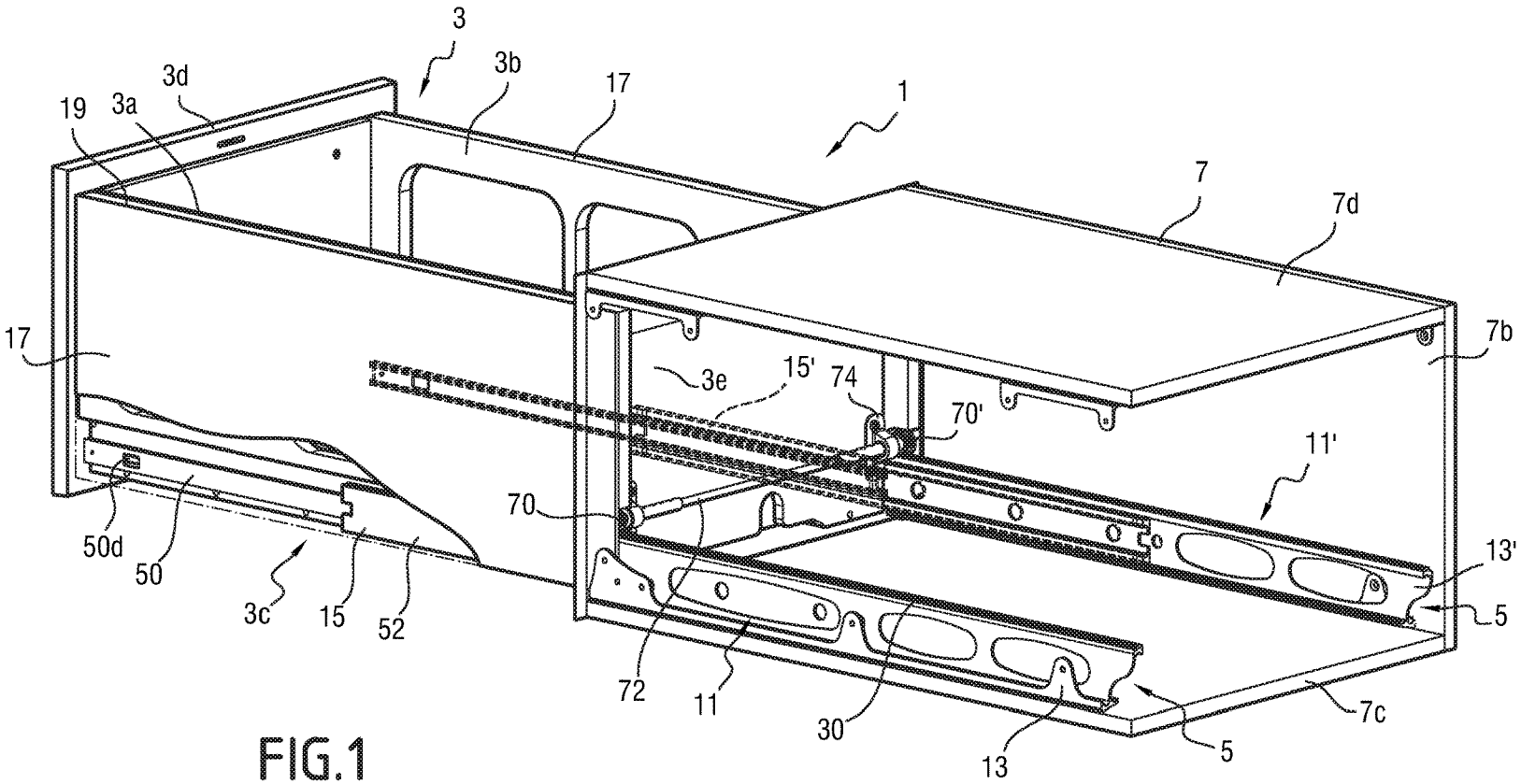
FIG. 1 is a partly cut-away perspective view, seen from the side and from behind, of a drawer assembly according to a first embodiment of the invention, the drawer being in an open position.

The enclosure 7 comprises a first and a second side walls 7*a*, 7*b*, only one of which is visible on FIG. 1. The enclosure 7 further comprises a bottom wall 7*c* and a top wall 7*d*.

In the closed position, the first and second side wall 3*a*, 3*b* of the drawer 3 face the first and second side walls 7*a*, 7*b* of the enclosure 7 respectively.

In this first embodiment, the first and second side walls 3*a*, 3*b* of the drawer 3 extend substantially over the whole height of the drawer 3.

In all the following, the selected orientations are indicative and are meant with respect to the Figures. In particular, the terms of "inner" and "outer" are meant relatively to the drawer assembly in use, "inner" designating a direction towards the inside of the enclosure 7 and outer designating a direction oriented towards the outside of the enclosure 7.

Moreover, the terms of «transverse», «longitudinal» and «vertical» should be understood with respect to the sliding direction of the drawer 3, which is a longitudinal direction. In particular, the term of «longitudinal» refers to a direction parallel to the sliding direction of the drawer 3, the term of «transversal» refers to a direction orthogonal to the sliding direction of the drawer 3 and contained in a plane parallel to the bottom wall 3*c* of the drawer 3, and the term of «vertical» refers to a direction orthogonal to the sliding direction of the drawer 3 and contained in a plane orthogonal to the bottom wall 3*c* of the drawer 3.

Besides, a longitudinal plane should be understood as a plane parallel to the bottom wall 3*c* of the drawer, a transversal plane should be understood as a plane parallel to the front wall 3*d* of the drawer 3 and a vertical plane should be understood as a plane parallel to the side walls 3*a*, 3*b* of the drawer.

Furthermore, by «length» a dimension of an object in the longitudinal direction will be referred to, by «width» a dimension of an object in a transverse direction, and by «height» a dimension of an object in a vertical direction.

The slide assembly 5 is configured to allow slidably opening and closing the drawer 3 with respect to the enclosure 7.

The slide assembly 5 comprises a first and a second slide systems 11, 11'.

The first slide system 11 and the second slide system 11' are configured to allow a sliding of the first wall 3*a* of the drawer 3 relative to the first wall 7*a* of the enclosure 7, and a sliding of the second wall 3*b* of the drawer 3 relative to the second wall 7*b* of the enclosure 7 respectively.

The first and second slide systems 11, 11' are symmetrical about a vertical plane. Subsequently, the first slide system 11 will be further described with reference to the Figures, it being considered that this description is applicable, by symmetry, to the second slide system 11'.

The first slide system 11 comprises an outer slide 13 for mounting the first slide system 11 on the inner surface of the first side wall 7*a* of the enclosure 7, and a sliding member 15. The first slide system 11 further comprises a casing element 17 and a spacer 19.

The outer slide 13 is fixed to the first side wall 7*a* of the enclosure 7. The outer slide 13 extends in a longitudinal direction.

The outer slide 13 comprises a fixing part 21 for attachment to the first side wall 7*a* of the enclosure 7. The outer slide 13 further comprises a sliding part 23, comprising a slide outer channel 25 for sliding the sliding member 15. The outer slide 13 further comprises an intermediate part 27, which protrudes inwardly from the fixing part 21 to the sliding part 23.

The fixing part 21, the intermediate part 27 and the sliding part 23 define a groove 29 extending upwardly from the intermediate part 27. Preferably, the groove 29 has a substantially U-shaped cross-section.

Preferably, the slide system 5 comprises a rack 30, which is fixed relative to the enclosure 7. The rack 30 extends longitudinally. Preferably, the length of the rack 30 is equal to or higher than the length of the drawer 3.

Figure 5:
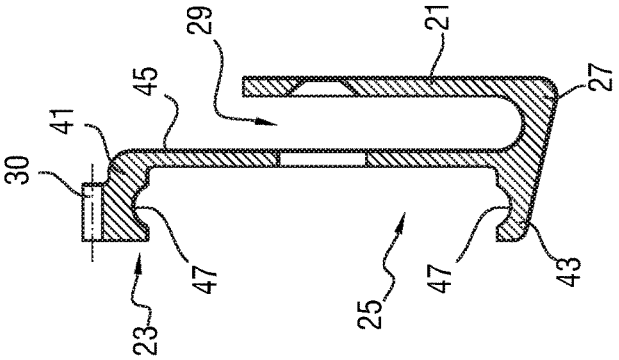
FIG. 5 is a view along a transversal section along line V-V of the outer slide of FIG. 4.
Figure 4:
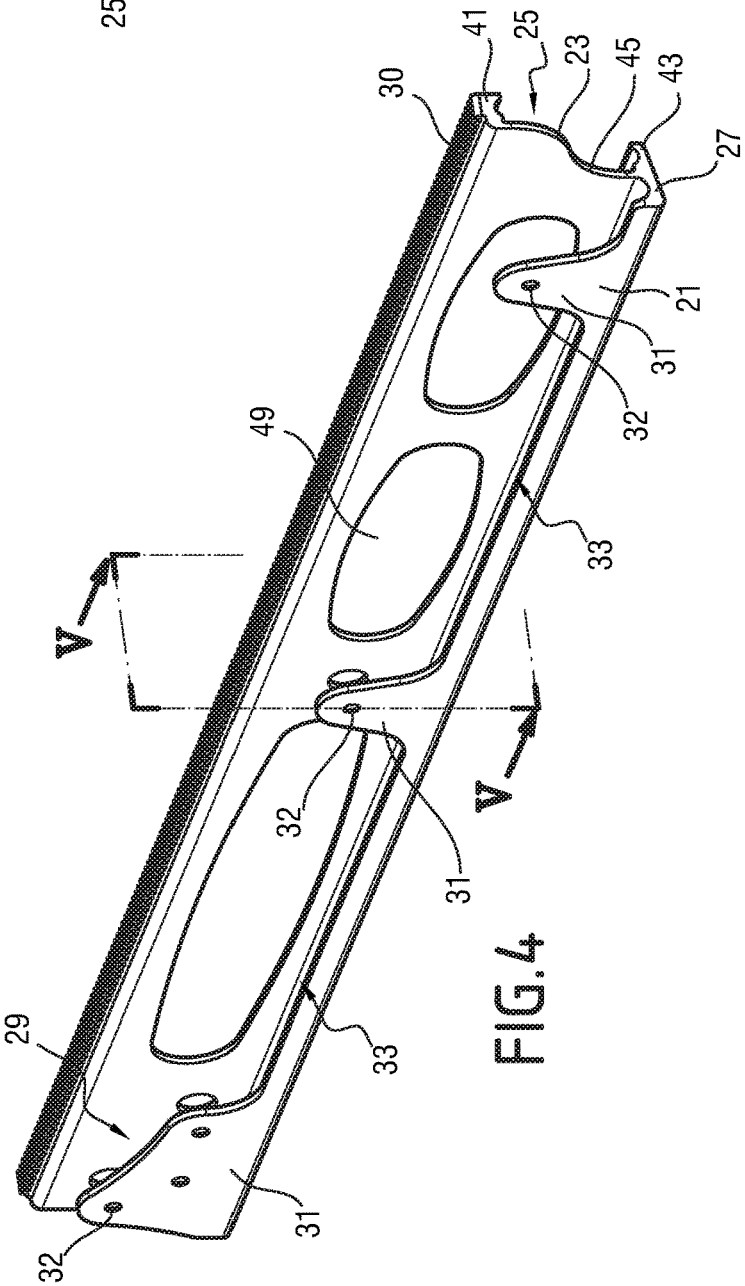
FIG. 4 is a perspective view of an outer slide of the slide system of FIG. 3.

For example, as illustrated on FIGS. 4 and 5, the rack 30 is formed on the sliding part 23. Preferably, the rack 30 extends longitudinally on the whole length of the sliding part 23.

As illustrated in further details on FIGS. 4 and 5, the fixing part 21 extends vertically from an upper portion to a lower portion. The fixing part 21 comprises several mounting brackets 31 provided with through holes 32 for fixing the outer slide 13 to the inner surface of the first side wall 7*a* of the enclosure 7. Between the mounting brackets 31, the fixing part 21 is provided with apertures 33 intended to limit the overall weight of the slide system.

The sliding part 23 comprises an upper arm 41, a lower arm 43 and a side arm 45, the side arm 45 extending vertically between the upper arm 41 and the lower arm 43. The upper arm 41, the lower arm 43 and the side arm 45 jointly define the slide outer channel 25. Hence, the slide outer channel 25 has a substantially C-shaped cross-section.

Each of the upper and lower arms 41, 43 is provided, on its surface facing the slide outer channel 25, with a longitudinal slot 47 for receiving gliding elements, for example ball bearings, intended to promote the sliding of the sliding member 15 in the slide outer channel 25.

Preferably, the side arm 45 extends longitudinally over the whole length of the outer slide 13. However, as illustrated on FIG. 4, the side arm 45 preferably comprises apertures 49 intended to limit the overall weight of the slide system.

The upper arm 41 preferably extends over the whole length of the outer slide 13.

Preferably, the rack 30 is formed on the upper surface of the upper arm 41.

The rack 30 is for example machined in the upper arm 41. Alternatively, the rack 30 is provided as a rack, for example made of plastic, fixed to the upper surface of the upper arm 41.

The rack 30 preferably extends over the whole length of the upper arm 41. In a preferred embodiment, the upper arm 41 extends over the whole length of the outer slide 13, and the rack 30 extends over the whole length of the upper arm 41, so as to maximize the course of the drawer 3 relative to the enclosure 7 for a given length of the outer slide 13.

The intermediate part 27 extends in a substantially longitudinal plane. Especially, the intermediate part 27 connects the lower portion of the fixing part 21 to a lower portion of the side arm 45.

The groove 29 is therefore defined jointly by the fixing part 21, the intermediate part 27 and the side arm 45.

Preferably, the outer slide 13 is configured so that, in use, the bottom of the groove 29, formed by the intermediate part 27, is located below the lower edge of the first side wall 3*a* of the drawer 3.

The sliding member 15 is mounted on the outer surface of the first side wall 3*a* of the drawer 3. The sliding member 15 extends in a longitudinal direction, facing the outer slide 13. The sliding member 15 is slidably movable within the slide outer channel 25, thus allowing a sliding of the drawer relative to the enclosure 7.

Preferably, the sliding member 15 comprises an interface rail 48, an inner rail 50 and a middle rail 52.

The interface rail 48 is fixed, for example screwed, to the outer surface of the first side wall 3*a* of the drawer 3.

The interface rail 48 extends longitudinally on the side wall 3*a*, preferably over the whole length of the side wall 3*a*. As visible on FIG. 3, the interface rail 48 has a T-shaped cross-section: the interface rail 48 comprises a foot 48*a* fixed on the side wall 3*a* and a head 48*b* destined to be received in a channel of the inner rail 50.

The inner rail 50 extends longitudinally, preferably over the whole length of the drawer 3.

The inner rail 50 comprises an upper arm 50*a*, a lower arm 50*b* and a side arm 50*c*, jointly defining a channel which is complementary to the cross-section of the head 48*b* of the interface rail 48. The inner rail 50 has a C-shaped cross-section.

The inner rail 50 is mounted on the interface rail 48 by sliding longitudinally the inner rail 50 relative to the interface rail 48, the head 48*b* sliding within the channel of the inner rail 50.

Preferably, the interface rail 48 comprises a releasable fastener destined to engage a cutout 50*d* provided in the inner rail 50 (visible on FIG. 1) at the end of this sliding, so that the inner rail 50 and the interface rail 48 are fastened together.

If needed, the inner rail 50 can be disengaged from the interface rail 48 by actuating the fastener through the cutout 50*d*, thus releasing the fastener, and then sliding the inner rail 50 back relative to the interface rail 48.

Therefore, the interface rail 48 allows releasably mounting the inner rail 50 on the drawer 3.

The middle rail 52 is slidably mounted on the inner rail 50, i.e. is slidably movable in a longitudinal direction relative to the inner rail 50. Furthermore, the middle rail 52 is slidably movable in a longitudinal direction relative to the outer slide 13, within the slide outer channel 25.

Especially, the middle rail 52 comprises a slide middle channel 54, configured to receive the inner rail 50 whilst allowing a sliding of the inner rail 50 relative to the slide middle channel 54 within said slide middle channel 54.

Preferably, the middle rail 52 has a C-shaped cross-section, which is complementary to the cross-section of the slide outer channel 25. The middle rail 52 comprises an upper arm 56, a lower arm 58 and a side arm 60, jointly defining the slide middle channel 54.

The upper arm 56 and the lower arm 58 are preferably provided, on their surface oriented towards the slide outer channel 25, with longitudinal slots 62 facing the slots 47 of the upper arm 41 and lower arm 43 of the sliding part 23.

Preferably, gliding elements, for example ball bearings, are provided between the upper arm 41 of the sliding part 23 of the outer slide 13 and the upper arm 56 of the middle rail 52, and between the lower arm 43 of the sliding part 23 and the lower arm 58 of the middle rail 52 and the lower arm 43, to promote the sliding of the middle rail 52 in the slide outer channel 25. The gliding elements are received in the longitudinal slots 47, 62.

The upper arm 56 and the lower arm 58 are further provided, on their surfaces oriented towards the slide middle channel 54, with longitudinal slots 64 for receiving the inner rail 50.

The inner rail 50 is configured to fit in the slide middle channel 54. Preferably, gliding elements, for example ball bearings, are provided between the upper arm 56, respectively lower arm 58, of the inner rail, and the upper arm 50*a*, respectively lower arm 50*b*, of the inner rail 50, to promote the sliding of the inner rail 50 relative to the middle rail 52. These gliding elements are for example received in the longitudinal slots 64 and corresponding longitudinal slots provided on the outer surfaces of the upper and lower arms 50*a*, 50*b*.

Preferably, the sliding member 15 and the outer slide 13 are provided with stop elements 61, 66, configured to limit the course of the inner rail 50 relative to the middle rail 52 and to limit the course of the middle rail 52 relative to the outer slide 13. Preferably, the stop elements 61, 66 are provided with dampening elements.

The casing element 17 is configured to conceal the sliding member 15 when the drawer 3 is slided from its close position towards its open position.

Especially, the casing element 17 is configured to encase the sliding member 15.

The casing element 17 extends in a vertical plane. The casing element 17 extends longitudinally from the front edge to the rear edge of the first side wall 3*a* of the drawer 3.

Furthermore, the casing element 17 extends vertically from an upper portion of the first side wall 3*a* of the drawer 3, towards the bottom of the side wall 3*a* and especially towards the intermediate part 27. The bottom part of the casing element 17 is thus received within the groove 29.

Preferably, the bottom of the groove 29 being located below the lower edge of the first side wall 3*a* of the drawer 3, the lower edge of the casing element 17 is located at the same height as or below the lower edge of the first side wall 3*a*.

Owing to the specific shape of the outer slide 13, the casing element 17 conceals the sliding member 15 without hindering the connection between the outer slide 13 and the sliding member 15.

The spacer 19 is interposed between the first side wall 3*a* of the drawer 3 and the casing element 17. The spacer 19 is configured to space the casing element 17 from the first side wall 3*a* of the drawer 3, so that the sliding member 15 may be accommodated between the casing element 17 and the first side wall 3*a* of the drawer 3.

Preferably, the spacer 19 extends longitudinally from the front edge to the rear edge of the first side wall 3*a*, and vertically from the upper edge of the first side wall 3*a* towards the sliding member 15. Especially, when the drawer 3 is in the closed position or partly opened, the spacer 19 abuts the upper arm 41 of the fixing part 21 of the outer slide 13.

Preferably, the casing element 17 is fixed to the spacer 19.

Figure 2:
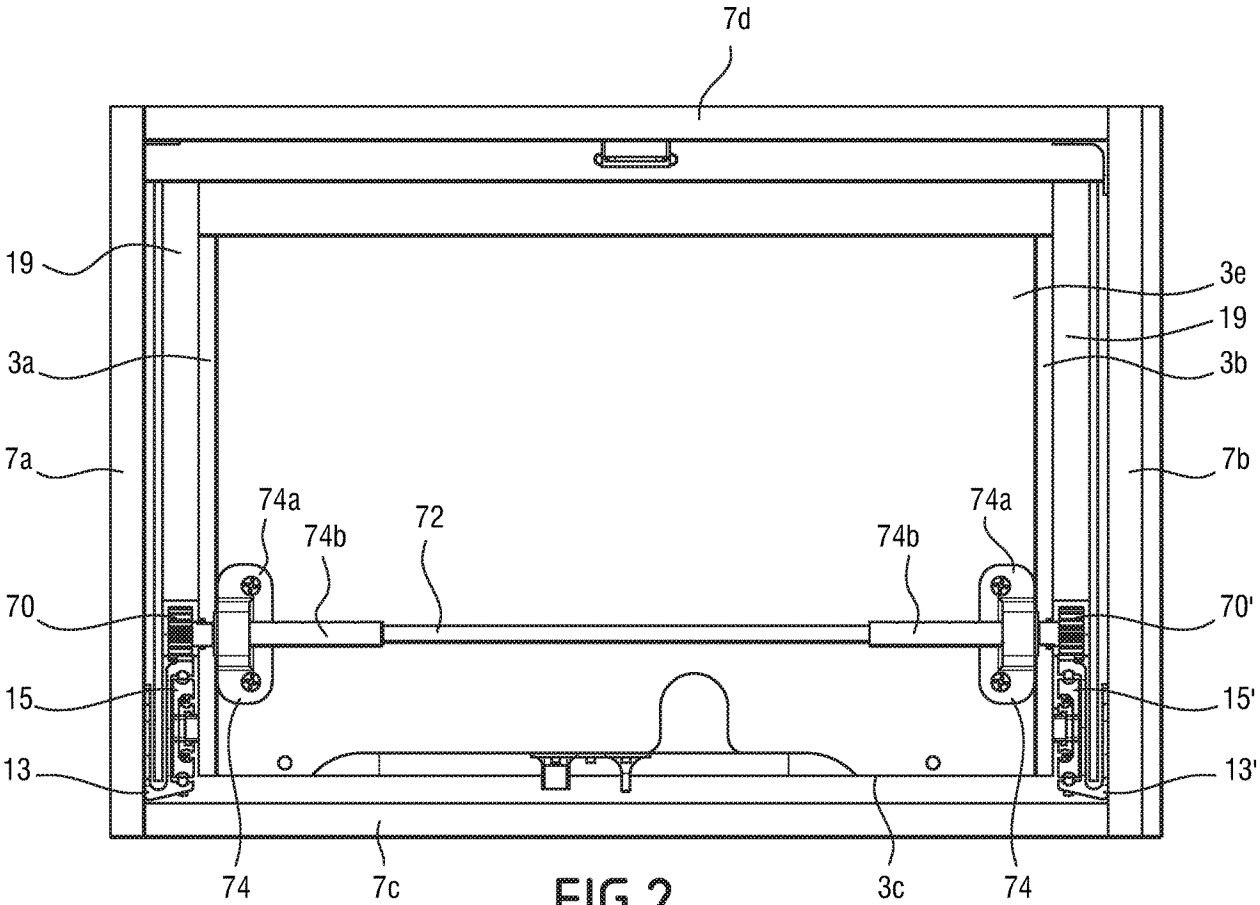
FIG. 2 is a view from behind of the drawer assembly of FIG. 1, in the closed position.
Figure 3:
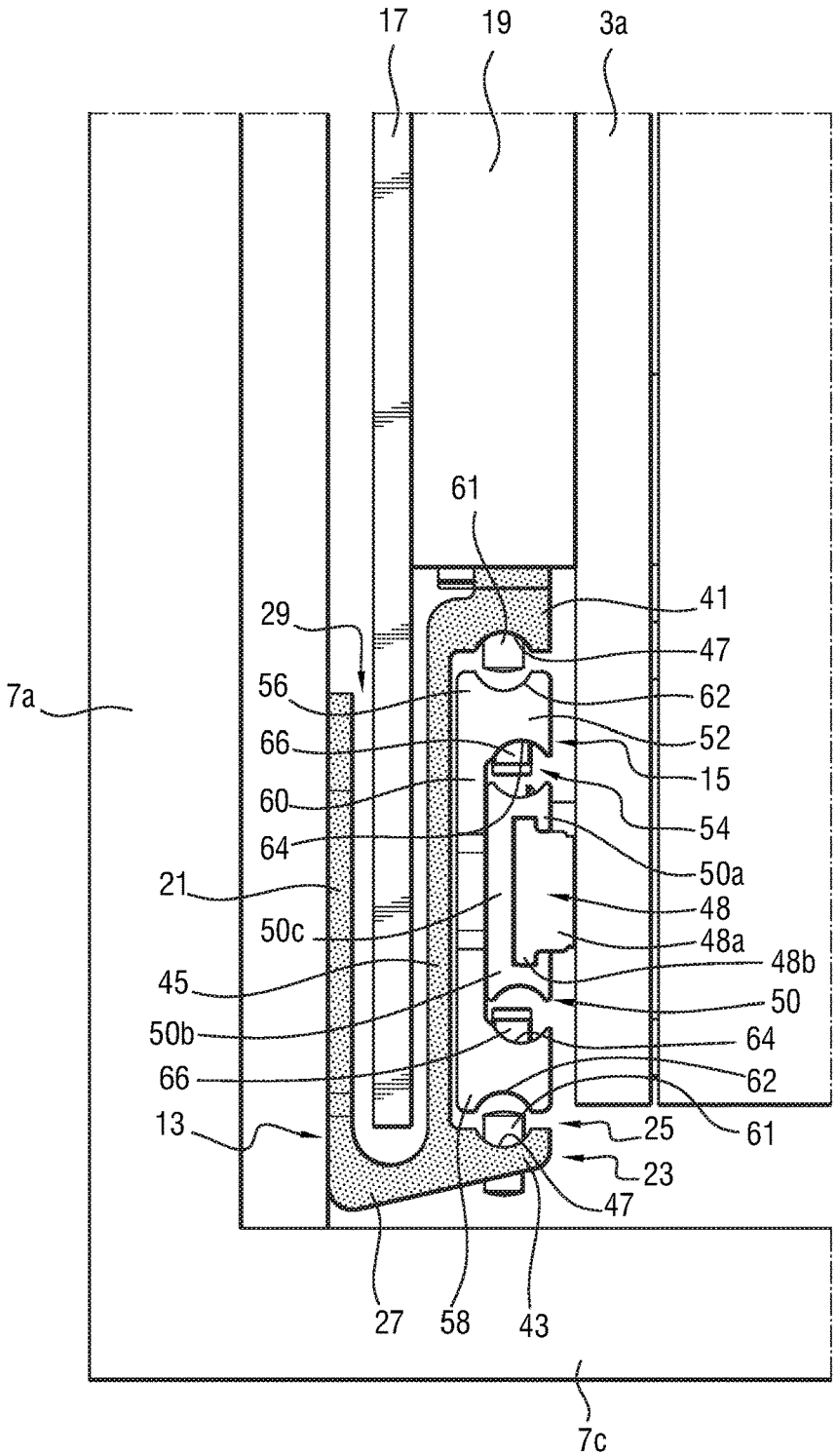
FIG. 3 is a view along a transversal section, seen from behind, of a slide system of the drawer assembly of FIG. 1, in the closed position.
Figure 6:
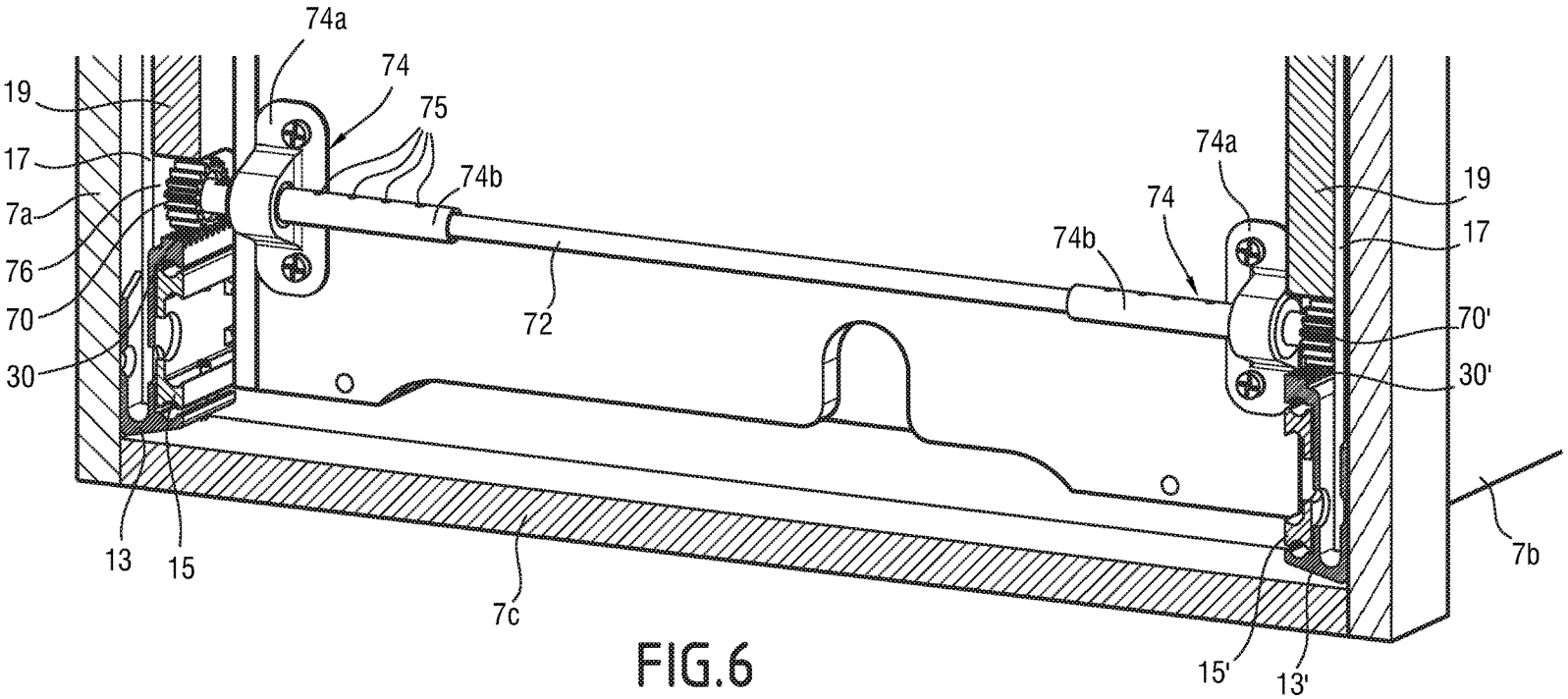
FIG. 6 is a perspective view from behind of the drawer assembly of FIG. 1.

As visible on FIGS. 1, 2 and 6, the first slide system 11 further comprises a pinion 70 mounted on the drawer 3 and engaging teeth of the rack 30 while rotating about itself when the drawer 3 slides relative to the outer slide 13.

Preferably, as illustrated on the Figures, the pinion 70 protrudes transversally from the side wall 3*a* of the drawer 3.

As previously explained, the first and second slide systems 11, 11' are symmetrical about a vertical plane. Hence, the second slide system 11' comprises elements symmetrical to those of the first slide system 11 about the vertical plane.

Especially, the second slide system comprises a sliding member 15' and an outer slide 13' comprising a sliding part 23', the sliding part 23' including a rack 30' extending longitudinally over the whole length of the sliding part 23'. The second slide system 11' further comprises a casing element 17 configured for encasing the sliding member 15', and a spacer 19, interposed between the side wall 3*b* of the drawer 3 and the casing element 17. The second slide system 11' further comprises a pinion 70' mounted on the drawer 3 and engaging teeth of the rack 30' while rotating about itself when the drawer 3 slides with respect to the outer slide 13".

Furthermore, the pinion 70 of the first slide system 11 is rotationally connected to the pinion 70' of the second slide system 11' by a shaft 72. The shaft 72 synchronizes the rotations of the pinions 70, 70'. Hence, the courses of the pinions 70, 70' on the racks 31, 31' are at any time identical, so that the courses of the sliding members 15, 15' of the first and second slide systems 11, 11' relative to outer slides 13, 13' are synchronized. Hence, any unwanted oscillations of the drawer in the transversal direction are suppressed.

The shaft 72 is preferably rotatably mounted about a transversal axis on the outer surface of the rear wall 3*e* of the drawer 3.

Especially, the shaft 72 is for example mounted on the outer surface of the rear wall 3*e* by means of two pinion support assemblies 74.

Each pinion support assembly 74 comprises a bearing support 74*a* fixed on the outer surface of the rear wall 3*e*, the bearing support 74*a* comprising a transversal through hole.

Each pinion support assembly 74 further comprises a pinion axis 74*b* rotatably mounted on the bearing support 74*a* by being partly received in the transversal through hole.

Each pinion axis 74*b* and each end portion of the shaft 72 is provided with at least one pin hole.

When mounting the shaft 72 on the drawer 3, the shaft is inserted in the pinion axes 74*b* and is fixed thereto by means of spring pins engaging, on each end of the shaft 72, a pin hole of the shaft 72 and a pin hole of the corresponding pinion axis 74*b*.

The pinions 70, 70' are then fixed on each pinion axis 74*b*, for example by means of spring pins.

Preferably, each pinion axis 74*b* is provided with a first pattern 75 of pin holes, distributed transversally, and the shaft 72 is provided at its two end portions with a second pattern of pin holes, also distributed transversally. Providing these patterns allows, from a shaft 72 having a given length, adjusting the distance between the bearing supports 74*a*, depending on the width of the drawer, and thus adapting a shaft having a fixed length to a wide range of drawer widths.

Still preferably, the distance between the pin holes of the first pattern differs from the distance between the pin holes of the second pattern, which provides a finer adjustment of the shaft 72 to the width of the drawer.

As visible on FIG. 6, the spacer 19 comprises cutouts 76 for receiving the pinion 70.

Thus, the mounting racks 74 allow a rotation of the shaft about itself, and a corresponding rotation of the pinions 70, 70', whilst preventing any rotation of the axis about a vertical axis, hence preventing a desynchronization of the rotations of the pinions 70, 70'.

In use, when the drawer 3 is pulled from the closed position towards the open position, the sliding members 15, 15' slide relative to the outer slides 13, 13' within the slide outer channel 25. Especially, the middle rails 52 slide within the slide outer channels 25, and the inner rails 50 slide within the slide middle channels 54.

Furthermore, during this sliding motion, the casing elements 17 slide longitudinally in the grooves 29 and progressively leave the grooves 29. The casing elements 17 therefore conceal the sliding members 15, 15' throughout the whole sliding of the drawer 3, and when the drawer 3 reaches the open position.

Conversely, when the drawer 3 is pushed from the open position towards the closed position, the sliding members 15, 15' slide relative to the outer slides 13, 13' within the slide outer channel 25. Especially, the middle rails 52 slide within the slide outer channels 25, and the inner rails 50 slide within the slide middle channels 54.

During this sliding motion, the casing elements 17 slide longitudinally in the grooves 29 and progressively enter the grooves 29. The casing elements 17 therefore conceal the sliding members 15, 15' throughout the whole sliding of the drawer 3 towards the closed position.

The slide system and assembly therefore allow sliding the drawer whilst avoiding an exposure of the slide system.

Furthermore, during these sliding motions, the pinions 70 and 70' engage the teeth of the racks 30, 30' while rotating about themselves, the rotations of the pinions 70 and 70' being synchronized by the shaft 72. Hence, the translational movements of the pinions 70 and 70' on the racks 30, 30' are synchronized, which ensures that the translational movements of the first and second side walls 3*a*, 3*b* of the drawer 3, relative to the enclosure 7, are synchronized. Consequently, the drawer 3 is movable relative to the enclosure 7 with only one degree of freedom, so that any rotational movements or oscillations of the drawer about a vertical axis are suppressed.

However, according to an embodiment, the slide system and assembly are devoid of racks and pinions.

Figure 7:
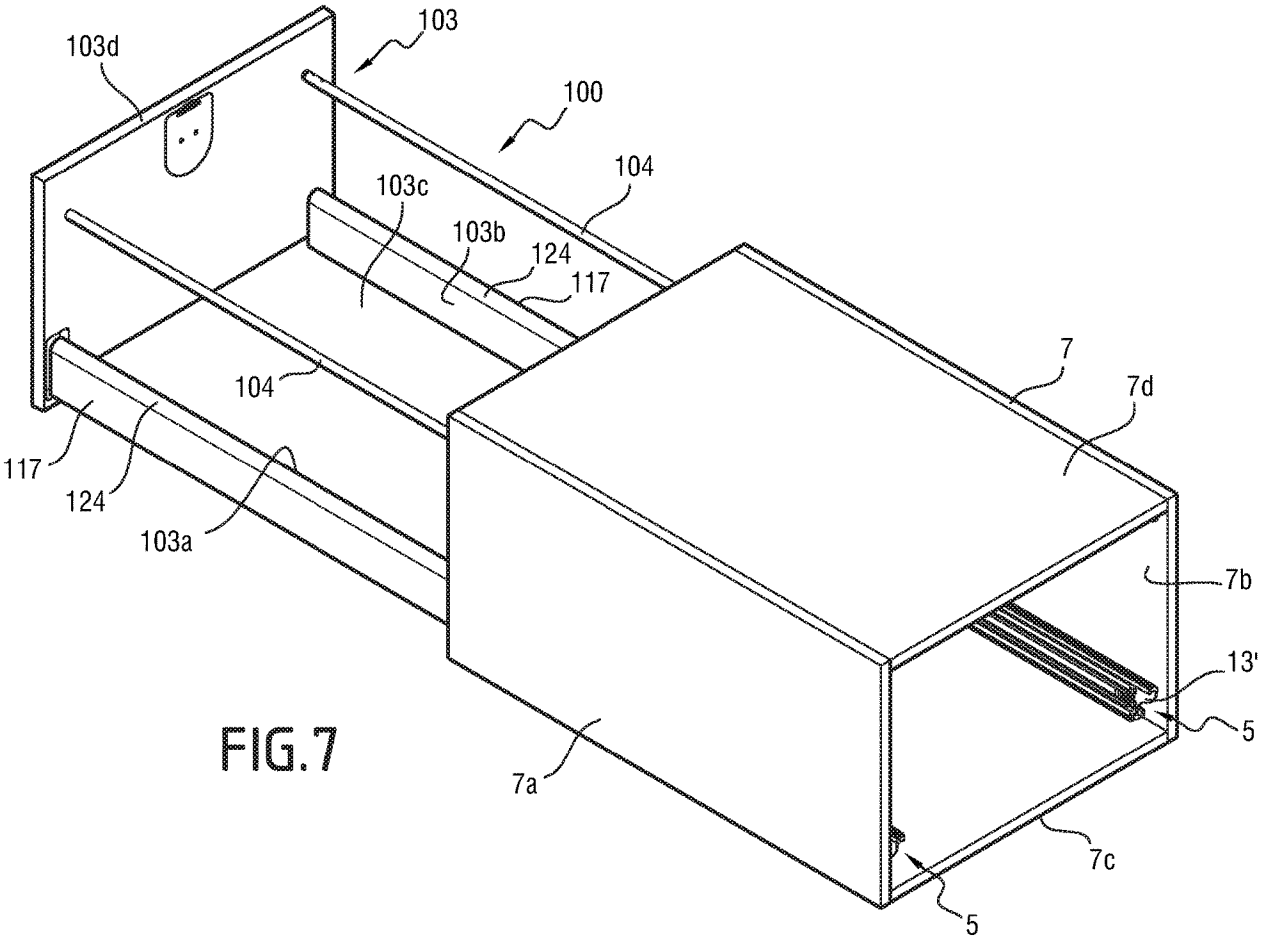
FIG. 7 is a partly cut-away perspective view, seen from the side and from behind, of a drawer assembly according to a second embodiment of the invention, the drawer being in an open position.
Figure 8:
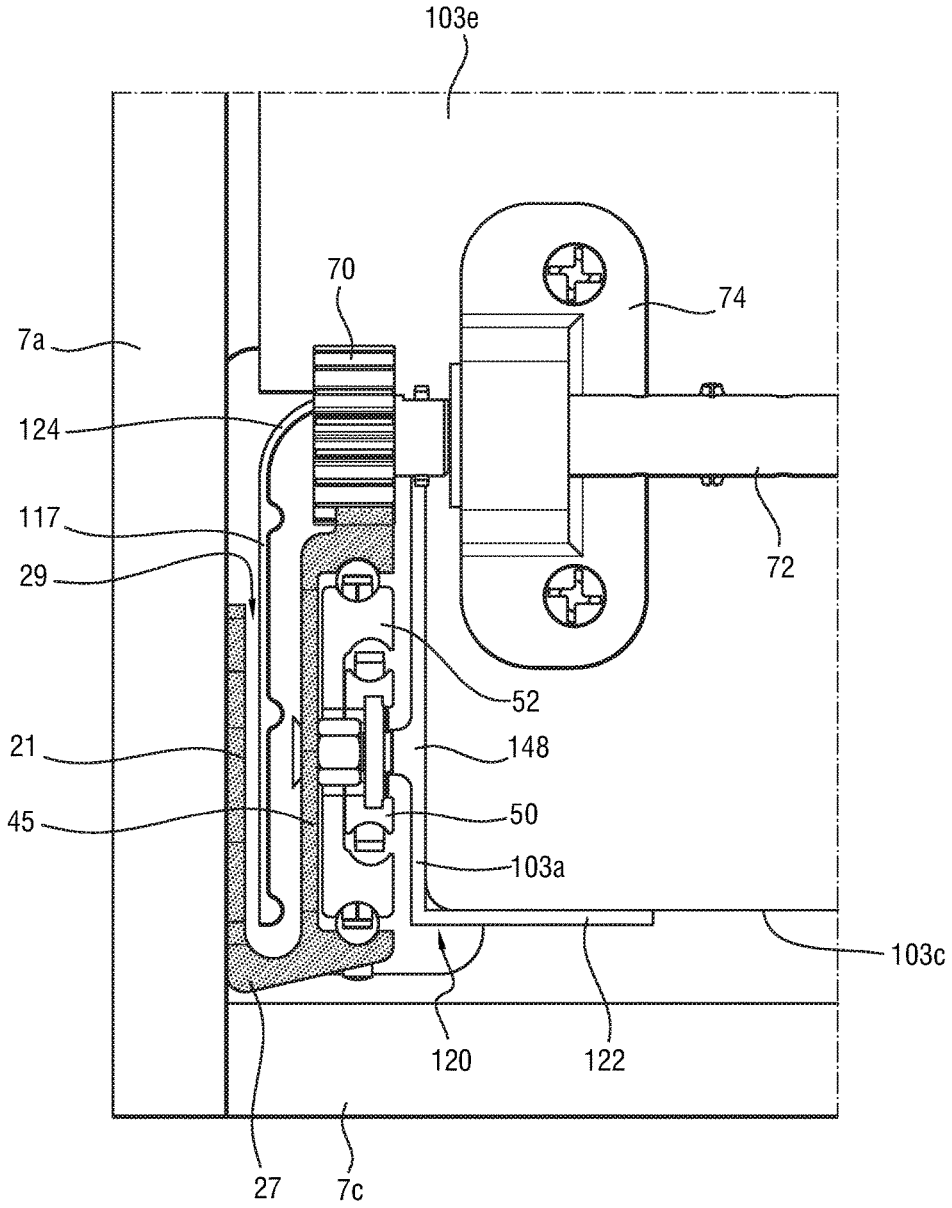
FIG. 8 is a view from behind of a detail of the drawer assembly of FIG. 8, in the closed position.

FIGS. 7 and 8 illustrate a drawer assembly 100 according to a second embodiment of the invention.

On FIGS. 7 and 8, the elements which are similar to the corresponding elements of the first embodiment, illustrated with reference to FIGS. 1 to 6, are designated with the same numeric references.

In this second embodiment, the drawer 103 comprises a first and a second side walls 103*a*, 103*b*, a bottom wall 103*c*, a front wall 103*d* and a rear wall 103*e*.

However, the first side wall 103*a* and the second side wall 103*b* do not extend over the whole height of the drawer 103, but only over a small portion of the height of the drawer 103. For example, the height of the first 103*a* and second 103*b* side walls is lower than 50%, preferably lower than 30%, of the height of the front wall 103*d*.

The drawer preferable comprises longitudinal strands 104 for between the front wall 103*d* and the rear wall 103*e*.

Furthermore, each of the first and second side wall 103*a*, 103*b* is made integral with the corresponding casing element 117 and interface rail 148. Thus, each slide system comprises the first and second side walls 103*a*, 103*b*.

Hence, in this second embodiment, each of the first and second slide systems comprises a side extruded profile 120, which includes the side wall 103*a* or 103*b*, the casing element 117 and the interface rail 148.

Especially, as illustrated in details on FIG. 8, each side extruded profile 120 comprises a longitudinal lower portion 122, which is configured to be fixed on the bottom wall 103*c* of the drawer 103, for example on the outer surface of the bottom wall 3*c*.

Each side extruded profile 120 further comprises a first vertical portion extending upwards from the longitudinal lower portion 122, this first vertical portion forming the side wall 103*a* or 103*b* of the drawer 103. The interface rail 148 protrudes from this first vertical portion.

Each side extruded profile 120 also comprises a joining portion 124, which extends in a substantial longitudinal plane from the upper edge of the side wall 103*a* or 103*b*, and a second vertical portion forming the casing element 117, which extends vertically from the joining portion 124 towards the bottom of the groove 29 and especially towards the intermediate part 27. Thus, the joining portion 124 joins the side wall 103*a* or 103*b* to the casing element 117.

In this second embodiment, the first and second slide systems generally do not comprise any spacer 19.

In a variant of this second embodiment, the drawer assembly 100 further comprises wall extensions extending from each longitudinal strand 104 to the side walls 103*a* and 103*b*, thereby the gap between the longitudinal strands 104 and the side walls 103*a* and 103*b*. For example, each longitudinal strand 104 comprises a longitudinal slot opening downwardly and destined to accommodate an upper edge of the wall extension. Preferably, each wall extension is made of a metallic material, and each side wall 103*a*, 103*b* is provided with magnets. Thus, each wall extension is fitted on its upper edge in the longitudinal slot of the longitudinal strand 104, and is secured on its lower end to side wall 103*a* or 103*b*.

The first and second embodiment can be combined. For example, in a variant of the first embodiment, the casing element 17 may be made integral with the side wall of the drawer. In this variant, each slide system 11, 11' comprises the first and second side walls 3*a*, 3*b*.

What is claimed is:

1. A slide system for slidably opening and closing a drawer with respect to an enclosure, said slide system comprising:

an outer slide for mounting said slide system on a side wall of the enclosure, said outer slide comprising a longitudinal slide outer channel, a sliding member, configured to be mounted on a side wall of the drawer, said sliding member being slidably movable within said slide outer channel, said outer slide comprising:

a fixing part for attachment of the outer slide on the side wall of the enclosure, a sliding part comprising said slide outer channel, and an intermediate part, extending from said fixing part to said sliding part, the fixing part, the intermediate part and the sliding part defining a groove extending upwardly from said intermediate part, the slide system further comprising a casing element configured for encasing the sliding member by extending vertically from an upper portion of the side wall of the drawer towards the intermediate part of the outer slide and being at least partly received within the groove, the slide system further comprising a side extruded profile including the casing element, the side extruded profile being a piece separate from the drawer and comprising:

a longitudinal lower portion being separate from and fixable on a bottom wall of the drawer, a first vertical portion being separate from the drawer and extending upwards from the longitudinal lower portion, and a second vertical portion being separate from the drawer and forming the casing element.

2. The slide system according to claim 1, wherein the sliding member comprises an inner rail, configured to be mounted in a fixed position relative to the side wall of the drawer, and a middle rail, mounted on said inner rail, said middle rail being slidably movable within said slide outer channel relative to said outer slide, and being slidably movable relative to said inner rail.

3. The slide system according to claim 2, wherein the sliding member further comprises an interface rail configured to be fixed to the side wall of the drawer, the inner rail being releasably fixable to said interface rail.

4. The slide system according to claim 1, wherein the sliding part comprises an upper arm, a lower arm and a side arm, the side arm extending between the upper arm and the lower arm, the upper arm, the lower arm and the side arm jointly defining the slide outer channel.

5. The slide system according to claim 4, wherein the groove is defined by the fixing part, the intermediate part and the side arm.

6. The slide system according to claim 1, further comprising a longitudinal rack, destined to be fixed relative to the enclosure, a pinion configured to be mounted on the drawer and to engage teeth of the rack while rotating about itself when the drawer slides with respect to the outer slide, and a pinion support assembly for mounting the pinion on the drawer.

7. The slide system according to claim 6, wherein:

the sliding part comprises an upper arm, a lower arm and a side arm, the side arm extending between the upper arm and the lower arm, the upper arm, the lower arm and the side arm jointly defining the slide outer channel, the longitudinal rack is formed on an upper surface of the upper arm, and the pinion support assembly is configured for being fixed to a rear wall of the drawer and for mounting the pinion protruding transversally from the side wall of the drawer.

8. A slide assembly comprising a first slide system and a second slide system, each of the first and second slide systems being according to claim 1.

9. The slide assembly according to claim 8, wherein:

each of the first and second slide systems comprise a longitudinal rack, destined to be fixed relative to the enclosure, a pinion configured to be mounted on the drawer and to engage teeth of the rack while rotating about itself when the drawer slides with respect to the outer slide, and a pinion support assembly for mounting the pinion on the drawer, and the slide assembly further comprises a shaft rotationally connecting the pinion of the first slide system to the pinion of the second slide system.

10. The slide assembly according to claim 9, wherein each pinion support assembly comprises:

a bearing support configured to be fixed to a rear wall of the drawer, the bearing support comprising a transversal through hole, and a pinion axis rotatably mounted on the bearing support by being partly received in the transversal through hole, each pinion axis is provided with a first pattern of pin holes, distributed transversally, and each end portion of the shaft is provided with a second pattern of pin holes, distributed transversally, a distance separating the pin holes of the first pattern differing from a distance separating the pin holes of the second pattern, each pinion axis being configured to be fixed to the corresponding end portion of the shaft by a spring pin engaging a pin hole of the pinion axis and a pin hole of the end portion of the shaft.

11. A drawer assembly comprising:

a drawer having a first and a second side walls, the slide assembly according to claim 8, the sliding member of the first slide system being mounted on the first side wall of the drawer, and the sliding member of the second slide system being mounted on the second side wall of the drawer.

12. The drawer assembly according to claim 11, wherein the casing element of the first slide system is made integral with the first side wall of the drawer, and the casing element of the second slide system is made integral with the second side wall of the drawer.

13. A cabinet assembly comprising:

an enclosure having a first and a second side walls, and a drawer assembly according to claim 11, the outer slide of the first slide system being mounted on the first side wall of the enclosure and engaging the sliding member of the first slide system, and the outer slide of the second slide system being mounted on the second side wall of the enclosure and engaging the sliding member of the second slide system.

14. A slide system for slidably opening and closing a drawer with respect to an enclosure, said slide system comprising:

an outer slide for mounting said slide system on a wall of the enclosure, said outer slide comprising a longitudinal slide outer channel, a sliding member, configured to be mounted on a side wall of the drawer, said sliding member being slidably movable within said slide outer channel, wherein the outer slide comprises:

a fixing part for attachment of the outer slide on the wall of the enclosure, a sliding part comprising said slide outer channel, and an intermediate part, extending from said fixing part to said sliding part, the intermediate part and the sliding part defining a groove extending upwardly from said intermediate part, the slide system further comprises a casing element configured for encasing the sliding member by extending vertically from an upper portion the side wall of the drawer towards the intermediate part of the outer slide and being at least partly received within the groove, and the slide system comprises a side extruded profile which includes the casing element, the side extruded profile being a piece separate from the drawer and comprising:

a longitudinal lower portion separate from and fixable on a bottom wall of the drawer, a first vertical portion being separate from the drawer and extending upwards from the longitudinal lower portion, and a second vertical portion being separate from the drawer and forming the casing element.

15. A drawer assembly comprising:

a drawer having a front wall, a bottom wall and a first side wall, a first slide system for slidably opening and closing the drawer with respect to an enclosure, said first slide system comprising:

an outer slide for mounting said first slide system on the first wall of the enclosure, said outer slide comprising a longitudinal slide outer channel, a sliding member, mounted on the first side wall of the drawer, said sliding member being slidably movable within said slide outer channel, wherein the outer slide comprises:

a fixing part for attachment of the outer slide on the first wall of the enclosure, a sliding part comprising said slide outer channel, and an intermediate part, extending from said fixing part to said sliding part, the intermediate part and the sliding part defining a groove extending upwardly from said intermediate part, the first slide system further comprises a casing element configured for encasing the sliding member by extending vertically from an upper portion the first side wall of the drawer towards the intermediate part of the outer slide and being at least partly received within the groove, and the first slide system comprises a side extruded profile which includes the casing element, the side extruded profile being a piece separate from the drawer and comprising:

a longitudinal lower portion separate from and fixable on a bottom wall of the drawer, a first vertical portion being separate from the drawer and extending upwards from the longitudinal lower portion, the first vertical portion constituting the first side wall of the drawer, the height of the first side wall of the drawer being lower than a height of the drawer and lower than a height of the front wall of the drawer, and a second vertical portion being separate from the drawer and forming the casing element.

16. The drawer assembly according to claim 15, wherein the sliding member comprises an inner rail, mounted in a fixed position relative to the first side wall of the drawer, and a middle rail, mounted on said inner rail, said middle rail being slidably movable within said slide outer channel relative to said outer slide, and being slidably movable relative to said inner rail.

17. The drawer assembly according to claim 16, wherein the sliding member further comprises an interface rail fixed to the first side wall of the drawer, the inner rail being releasably fixable to said interface rail.

18. The drawer assembly according to claim 15, wherein the sliding part comprises an upper arm, a lower arm and a side arm, the side arm extending between the upper arm and the lower arm, the upper arm, the lower arm and the side arm jointly defining the slide outer channel.

19. The drawer assembly according to claim 18, wherein the groove is defined by the fixing part, the intermediate part and the side arm.

20. The drawer assembly according to claim 15, further comprising a longitudinal rack, destined to be fixed relative to the enclosure, a pinion mounted on the drawer and configured to engage teeth of the rack while rotating about itself when the drawer slides with respect to the outer slide, and a pinion support assembly for mounting the pinion on the drawer.

21. The drawer assembly according to claim 20, wherein:

the sliding part comprises an upper arm, a lower arm and a side arm, the side arm extending between the upper arm and the lower arm, the upper arm, the lower arm and the side arm jointly defining the slide outer channel, the longitudinal rack is formed on an upper surface of the upper arm, and the pinion support assembly is fixed to a rear wall of the drawer and mounts the pinion protruding transversally from the first side wall of the drawer.

22. The drawer assembly according to claim 15, comprising a second slide system comprising:

an outer slide for mounting said second slide system on a second wall of the enclosure, said outer slide comprising a longitudinal slide outer channel, a sliding member, mounted on a second side wall of the drawer, said sliding member being slidably movable within said slide outer channel, wherein said outer slide comprises:

a fixing part for attachment of the outer slide on the second wall of the enclosure, a sliding part comprising said slide outer channel, and an intermediate part, extending from said fixing part to said sliding part, the fixing part, the intermediate part and the sliding part defining a groove extending upwardly from said intermediate part, wherein the second slide system further comprises a casing element configured for encasing the sliding member by extending vertically from an upper portion of the second side wall of the drawer towards the intermediate part of the outer slide and being at least partly received within the groove, and wherein the second slide system comprise a side extruded profile which includes the casing element, the side extruded profile being a piece separate from the drawer and comprising:

a longitudinal lower portion being separate and fixable on the bottom wall of the drawer, a first vertical portion being separate from the drawer and extending upwards from the longitudinal lower portion, the first vertical portion constituting the second side wall of the drawer, the height of the second side wall being lower than the height of the front wall, and a second vertical portion being separate from the drawer and forming the casing element.

23. The drawer assembly according to claim 22, wherein:

each of the first and second slide systems comprises a longitudinal rack, destined to be fixed relative to the enclosure, a pinion mounted on the drawer and configured to engage teeth of the rack while rotating about itself when the drawer slides with respect to the outer slide, and a pinion support assembly for mounting the pinion on the drawer, and the drawer assembly further comprises a shaft rotationally connecting the pinion of the first slide system to the pinion of the second slide system.

24. The drawer assembly according to claim 23, wherein each pinion support assembly comprises a bearing support fixed to a rear wall of the drawer, the bearing support comprising a transversal through hole, and a pinion axis rotatably mounted on the bearing support by being partly received in the transversal through hole, each pinion axis is provided with a first pattern of pin holes, distributed transversally, and each end portion of the shaft is provided with a second pattern of pin holes, distributed transversally, a distance separating the pin holes of the first pattern differing from a distance separating the pin holes of the second pattern, each pinion axis being configured to be fixed to the corresponding end portion of the shaft by a spring pin engaging a pin hole of pinion axis and a pin hole of the end portion of the shaft.

25. A cabinet assembly comprising:

an enclosure having a first wall and a second wall, and the drawer assembly according to claim 22, the outer slide of the first slide system being mounted on the first wall of the enclosure and engaging the sliding member of the first slide system, and the outer slide of the second slide system being mounted on the second wall of the enclosure and engaging the sliding member of the second slide system.

* * * * *